United States Patent [19]

Kalve

[11] Patent Number: 4,611,440

[45] Date of Patent: Sep. 16, 1986

[54] WALKING DRAGLINE BASE FRAME AND REVOLVING FRAME CONSTRUCTION

[76] Inventor: Ernest Kalve, 6700 W. Lake Rd., Newburgh, Ind. 47630

[21] Appl. No.: 580,240

[22] Filed: Feb. 14, 1984

Related U.S. Application Data

[63] Continuation-in-part of Ser. No. 419,415, Sep. 20, 1982, abandoned.

[51] Int. Cl.[4] ..... E04B 1/346

[52] U.S. Cl. ..... 52/65; 52/116; 212/253; 414/744 R

[58] Field of Search ..... 248/349; 104/99; 105/28; 52/65, 81, DIG. 10, 116; 212/253, 254; 37/116; 414/744 R; 238/283

[56] References Cited

U.S. PATENT DOCUMENTS

| | | | |
|---|---|---|---|
| 1,421,009 | 6/1922 | Inman | 212/253 |
| 2,511,023 | 6/1950 | Thomas | 52/648 |
| 2,628,818 | 2/1953 | Graham | 52/646 |
| 3,565,336 | 2/1971 | Eisses | 238/283 |
| 4,037,894 | 7/1977 | Sankey | 212/69 |
| 4,231,699 | 11/1980 | Thompson | 212/253 |
| 4,262,461 | 4/1981 | Johnson et al. | 52/646 |
| 4,329,795 | 5/1982 | Kalve | 212/253 |
| 4,371,086 | 2/1983 | Sankey et al. | 212/252 |

FOREIGN PATENT DOCUMENTS

| | | | |
|---|---|---|---|
| 2303060 | 8/1973 | Fed. Rep. of Germany | 52/648 |
| 48841 | 7/1940 | Netherlands | 212/223 |
| 1558961 | 1/1980 | United Kingdom | 52/648 |
| 573541 | 9/1977 | U.S.S.R. | 52/648 |
| 679703 | 8/1979 | U.S.S.R. | 52/648 |

*Primary Examiner*—James L. Ridgill, Jr.

*Attorney, Agent, or Firm*—Hill, Van Santen, Steadman & Simpson

[57] ABSTRACT

Walking dragline base frame and revolving frame having an internal web grid of triangular cells in a concentric series of annular girders. Cell plates are oriented in circular and spiral arc arrangements, the spiral arcs extending both left hand and right hand in crossing relation. Segmented rail beam and rail pad structures are provided concentrically in one of the annular girders of the frames connected with intersecting diagonal web plates of the associated annular girder. The rail pads may be of double-T structure. A relative stiffness ratio of base frame and revolving frame approaching 1:1 is attained and wherein the revolving frame may be centrally of diminished depth and the base frame of complementary greater central depth.

22 Claims, 12 Drawing Figures

WALKING DRAGLINE BASE FRAME AND REVOLVING FRAME CONSTRUCTION

The present application is a continuation-in-part of my pending application Ser. No. 419,415 filed Sept. 20, 1982 now abandoned.

This invention relates to improvements in walking dragline base frame and revolving frame construction, and is more particularly concerned with such construction for attaining efficient resistance to torsional stresses imposed on such frame structures.

Large capacity walking dragline excavators have evolved into massive machinery structures having their own specific structural characteristics. These machines are designed to handle up to 350 cubic yards in each bucket load. However, these massive machines have retained or adapted many structural features from the smaller dragline excavators, and this has resulted in inefficient and improper stiffness ratios for individual structural elements, causing premature failures and excessive maintenance costs in respect to the tub or base frame structures and the revolving frames structures. In an effort to reduce the premature failures and maintenance costs, increased material thicknesses and sizes have been designed into the structures, not only for the parts that most often fail, but very often indiscriminately for the other structure. This further upsets the stiffness ratios and defeats utilization of the added strength. Due to the attempts to reduce failures by adding weight, the size and capacity of the walking dragline excavators has limited usefulness of these machines, and initial equipment costs and maintenance costs have spiralled.

A principal reason for unusual stresses in the frame structures of the walking dragline excavator resides in the fact that in service the base frames of the machine must be supported directly on the underlying soil surface. Soil rigidity and compaction properties cannot be accurately predicted or analytically defined. As a result, dragline excavator frames are subjected to analytically undefinable and unpredictable strain and stress concentrations in the frame. Since the revolving frame rides on the base frame and operating loads are transferred by the revolving frame to the base frame, both frames are stressed by any significant deformations of the base frame due to unpredictable supporting soil conditions which cause the base frame to be deflected or deformed under operating load.

By way of example of prior frame constructions which are subject to the problems just discussed and to the alleviation of which the present invention is directed, reference is made to U.S. Pat. No. 4,037,894 which discloses an essentially rectangular cell pattern of web plates in the frame structure. U.S. Pat. No. 4,329,795 is referred to as an example of radially arranged web plates providing essentially trapezoidal cell arrangement.

Observation of full size walking dragline machines in operation, and experiments with scale models, has shown that the frames of the machines having rectangular or trapezoidal cell arrangements, when subjected to torsional loading, as occurs with great frequency during operation, causes the vertical web plates to distort with a twisting, warping action. The transverse and longitudinal shear stresses thus generated tend to concentrate at the reentrant corners of the welded joints, both horizontal and vertical. When it is considered that the base frames of these machines may be up to 150 feet in diameter and as much as 8 feet in thickness, made up of steel plate from 1½ to 3 inches thick, depending on location of the parts, and associated structures of proportionate massive dimensions, including the revolving frame rotatably mounted on the base frame, the gantry structure, the dragline boom and bucket, as well as the counterweighting carried by the revolving frame to counterbalance the boom, it will be readily appreciated that the welded joints are subjected to tremendous stress and strain concentrations as a result of the twisting torsional movements in the web plates as well as rail beams in the frames. Serious joint failures are virtually unrepairable in the field because heavy welded joints result in high residual stresses and costly heat treatment is required to relieve those residual stresses. Proper maintenance repairs of the welded joints is thus not feasible because the stress relieving by heat treatment in a closed frame is virtually precluded. Serious failure of the welded joints therefore usually requires replacement of the entire frame, which is a very costly event.

It is therefore an important object of the present invention to provide a new and improved frame configuration which will more efficiently resist and distribute stress concentrations which may be caused by unpredictable soil conditions, and to assure better load sharing between base frame and revolving frame, than has been attained by prior constructions.

To the attainment of this object, the present invention provides a unique cell construction and arrangement for walking dragline base frames and revolving frames. The invention also provides a novel construction and relationship of the rail beams and related components in such frames.

In accordance with the present invention there is provided a massive hollow internally reinforced frame structure for a walking dragline excavator, comprising upper deck plate means and lower base plate means, and vertical web plates carried by and between the deck and base plate means and defining a continuous annular arrangement of generally triangular cells so that the web plates coact in load sharing manner for efficient resistance to torsional stresses imposed on the frame structures.

Further implementing the unique cellular frame structure is an advantageous orientation of the cell web plates in intersecting circular and spiral arcs.

Another desirable attribute of the present invention is a new and improved construction and orientation of the rail beams whereby the overall structural integrity of the frame does not depend on the performance of these beams and replacement may be effected without affecting the structural integrity of the entire frame.

Still another valuable attribute of the present invention resides in a substantially improved relationship of revolving frame wherein the relative stiffness ratio may approach a ratio of 1:1 without increasing combined depth of base frame and revolving frame. Thereby there is attained a desirable stiffness ratio for better utilization of all structural elements in both frames.

Other objects, features and advantages of the present invention will be readily apparent from the following description of certain representative embodiments thereof, taken in conjunction with the accompanying drawings, although variations and modifications may be effected without departing from the spirit and the scope of the novel concepts embodied in the disclosure, and in which.

Figure 1:
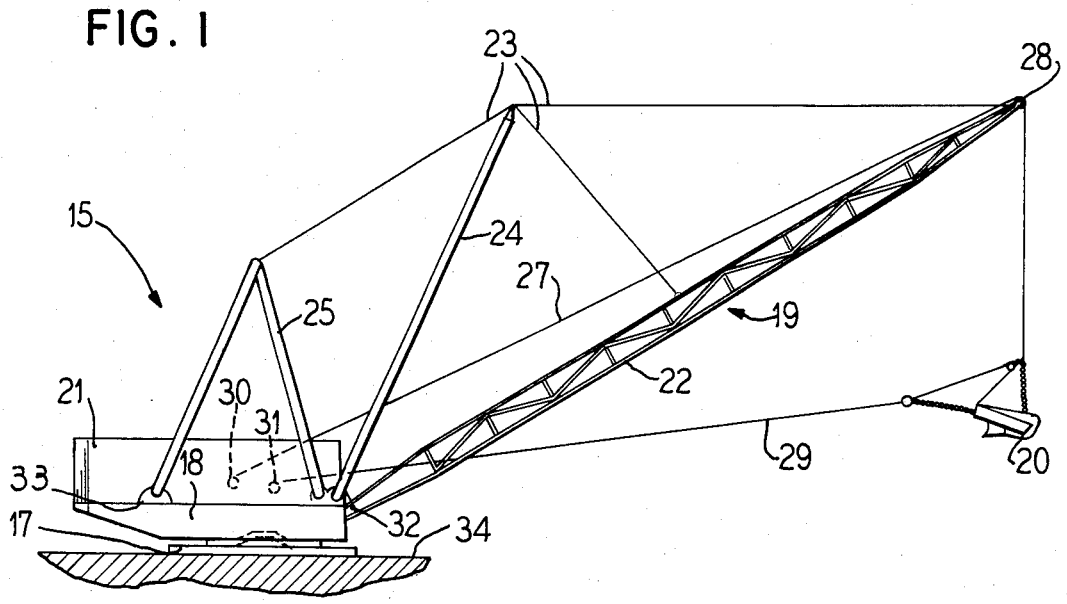
FIG. 1 is a more or less schematic side elevational view of a walking dragline excavator embodying the present invention.
Figure 2:
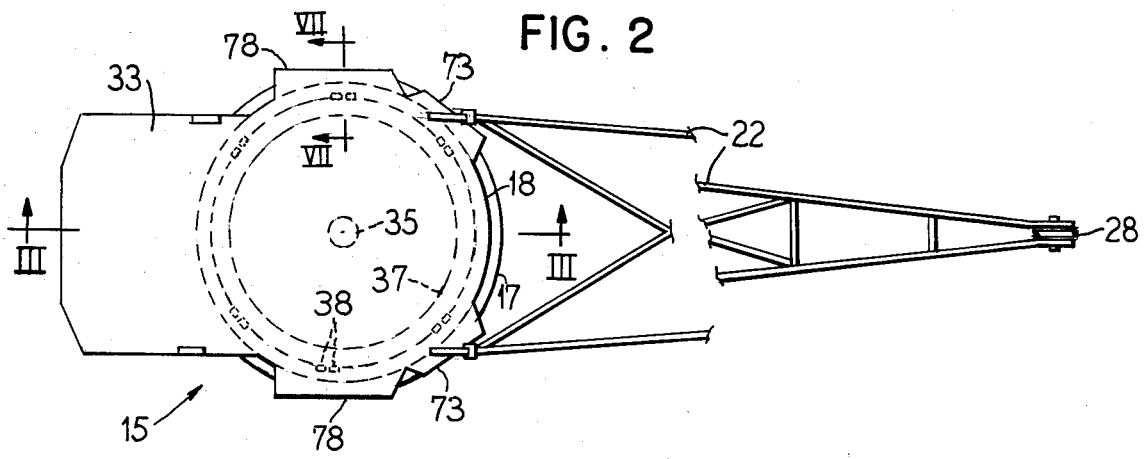
FIG. 2 is an enlarged fragmental top plan view of the excavator of FIG. 1.

As shown in FIGS. 1 and 2, a typical, schematically illustrated, walking dragline excavator 15 includes a generally planar base frame 17 supporting a revolving counterweighted generally planar frame 18 carrying boom means 19 by which a dragline bucket 20 is operated through suitable control means activated from the revolving frame. Conventional walking means (not shown) may be provided for raising and moving the excavator 15 when necessary.

A housing 21 on the revolving frame 18 may enclose operating machinery, controls, power source, and the like, as is customary with dragline excavators of this type. The boom means 19 comprises a boom 22 controlled by a cable system 23 operated from the control housing 21 and trained over a mast 24 and gantry frame 25. For operating the dragline bucket 20, a hoisting cable or rope 27 is trained over a pulley 28 at the top of the boom 22 and suspends the bucket 20 therefrom. A drag cable or rope 29 is attached to the bucket 20 in usual operating fashion. Operating drums 30 and 31 in and in association with the housing 21 operate the hoisting rope 27 and the drag rope 29, respectively, as controlled by the operator who is suitably accommodated in or in association with the housing 21. As is customary, the boom 22 is pivotly attached for vertical swinging movement to a front end of the revolving frame 18 as by means of pivot knuckles 32. At its rear end, the revolving frame 18 has a platform area 33 on or in which may be carried suitable counterweight means (not shown).

Figure 3:
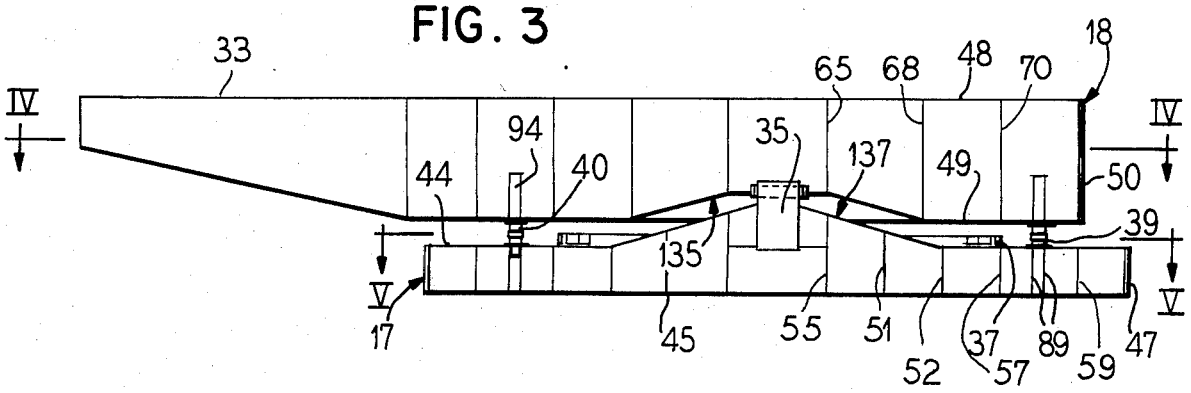
FIG. 3 is a further enlarged more or less schematic longitudinal sectional view taken substantially along the line III—III of FIG. 2.

The base frame 17 may be, as is usual, of circular form and adapted to lie directly on a ground surface 34. At about its center of weight, the revolving frame 18 is pivotally connected as by means of a center journal or vertical axle 35 (FIGS. 2 and 3) on the vertical axis of the base frame 17 for rotary driving of the revolving frame 18 relative to the base frame 17, there being provided any suitable means for controlling revolving of the frame 18, such as a customary swing gear 37 mounted on the deck of the base frame 17 and engaged by driven pinion means (not shown) carried by the revolving frame 18 and providing part of the operating machinery carried by the revolving frame.

Figure 8:
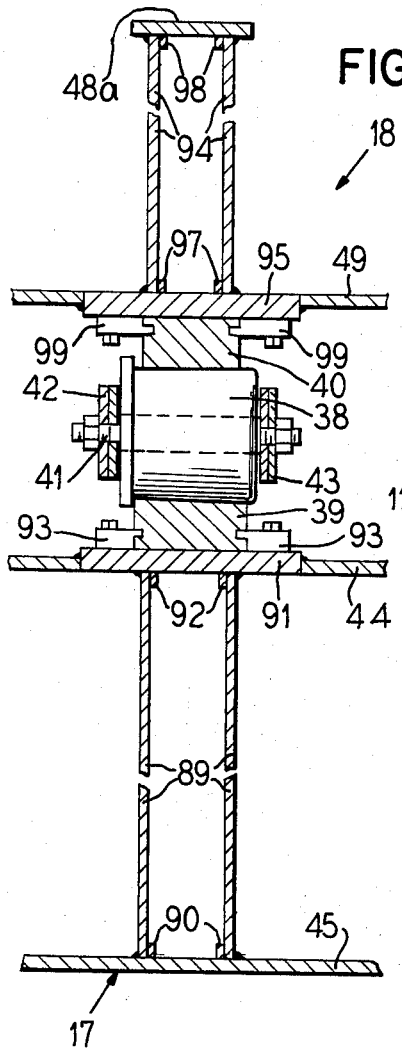
FIG. 8 is an enlarged fragmentary sectional detail view taken substantially along the line VIII—VIII of FIG. 2.

Rotary support of the revolving frame 18 on the base frame 17 is by means of radially inwardly tapered flanged rollers 38 (FIGS. 2 and 8) in a roller circle centered on the base frame 17 radially outwardly spaced from the swing gear 37 and riding on and between a complementary tapered lower annular rail 39 carried by the lower frame 17 and an upper complementary tapered annular rail 40 carried by the revolving frame 18. As is customary, the rollers 38 are maintained in proper series orientation by means of axle shafts 41 connected to respective radially inner and radially outer cage rings 42 and 43.

Each of the base frame 17 and the revolving frame 18 is of a hollow cellular construction comprising heavy steel plate assemblies all welded together in the frame structure and attaining maximum strength with minimum tonage of steel in the structure of the frames.

On the base frame 17, also sometimes referred to as tub, a hollow interior is defined between deck plate means 44 (FIGS. 3 and 5) which throughout at least its major extent is horizontally flat and vertically spaced above flat horizontal base plate means 45. A circumferential, vertically extending enclosure wall 47 is secured between the radially outer edges of the deck and base. To the same effect, the revolving frame 18 has essentially flat horizontal deck plate means 48 vertically spaced above base plate means 49 which throughout at least its major extent is horizontally flat, and a circumferential wall 50 encloses the space within the frame.

Within the base frame 17 and supporting the deck plate 48 on the base plate 49, a unique arrangement of vertical supporting and reinforcing webs formed from vertical web plates disposed in a uniform pattern of intersecting circular and spiral arcs, provides a triangular cell configuration attaining favorable distribution of externally applied loads on the base frame in any direction. As best visualized in FIG. 5 this grid system of web plates comprises an inner annular series of rigidly connected vertical web plates 51 providing an annular girder boundary web surrounded in radially spaced relation by an annular series of rigidly connected vertical web plates 52 providing another annular girder boundary web, with the junctures of the girder boundary web plates 51 with one another being connected to the junctures of the girder member web plates 52 with one another by rigidly attached diagonally extending vertical girder web plates 53 disposed in a zig-zag orientation and which together with the boundary web plates 51 and 52 define triangular cells. Extending radially inwardly from their juncture with the junctures of the web plates 51 are vertical girder web plates 54 which at their radially inner edges are rigidly joined to an annular vertical girder boundary and hub plate structure 55 within which is accomodated the supporting structure for the vertical axle 35. There is thus provided a radially inner first girder defined between the annular girder boundary web defined by the annularly arranged web plates 51 and the annular girder boundary web defined by hub plate structure 55. About the first girder a second annular girder is defined between the girder boundary defined by the annularly arranged web plates 51 and the annular girder boundary defined by the web plates 52. Radially outwardly therefrom there may be provided a third girder defined between the the girder boundary defined by the annularly arranged web plates 52 and a radially outwardly spaced rigidly connected annular series of vertical web plates 57 defining another girder boundary. Junctures of the web plates 57 are rigidly connected with the junctures of the web plates 52 by means of diagonal vertical girder web plates 58 in a zig-zag orientation and which define in the third girder an annular series of triangular cells.

Although the number of annular girders may vary, there may as shown be located radially outwardly contiguous to the third girder an annular fourth girder defined between the girder boundary defined by the annular series of vertical web plates 57 and a girder boundary defined by an annular radially outwardly spaced series of rigidly connected vertical web plates 59 the junctures of which are offset circumferentially relative to the junctures of the web plates 57 and are rigidly connected thereto by means of diagonal vertical girder web plates 60 arranged in a zig-zag orientation and defining with the boundaries a continuous annular series of triangular cells. There may also be provided a fifth and radially outermost annular girder about the fourth annular girder and defined between the girder boundary defined by the annular series of web plates 59 and the circumferential closure wall 47 spaced substantially radially outwardly therefrom and providing the outermost annular girder boundary for the base frames 17. A series of zig-zag diagonal vertical girder web plates 61 connected at the radially inner ends to the junctures of the annular series of web plates 59 and at their radially outer ends to one another and the peripheral wall 47 define with the boundaries an annular series of triangular cells within this girder. In addition and for further reinforcement, radially extending vertical girder web plates 62 may be rigidly connected between the inner ends of the diagonal web plates 61 and the peripheral girder boundary wall 47, thus dividing the triangles within the convergences of the web plates 61 into a pair of smaller triangles.

It will be observed that within the grid of vertical web plate providing the second, third and forth annular girders there is a uniform pattern of two annular rows of mutually overlapping hexagonal forms each of which is composed of six triangular cells.

Figure 6:
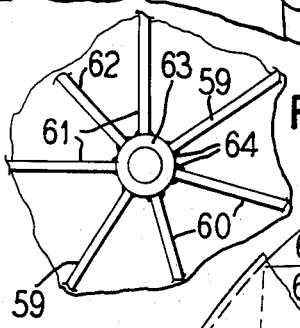
FIG. 6 is an enlarged fragmentary plan detail view taken substantially within the baloon VI of FIG. 5.

In FIG. 6 is shown a typical juncture connection of the several vertical girder web plates, and especially where the plates converge at the girder boundary members. At each multiple plate juncture may be provided a vertical joint member 63 which may be a tubular or solid post to which the respective convergent web plate edges are secured as by means of welding 64. This provides a desirably rigid joint at each such juncture convergence throughout the web grid.

A similar advantageous vertical supporting and reinforcing plate web grid and annular girder orientation is provided for the revolving frame 18. To this end, a central vertical hub 65 (FIGS. 3 and 4) provides an inner boundary member for a first annular girder which has circumferentially spaced radially extending vertical web plates 67 which join an annular series of vertical web plates 68 substantially spaced radially from hub 65 and defining an outer boundary member for this girder. A second annular girder is provided by and between girder boundary defined by the annular plate series 68 and a girder boundary member defined by an annular vertical web plate series 69 radially spaced about the plate series 68 and connected thereto by radially extending vertical girder plate extensions 70 of the radial girder plates 67. Vertical alternately oppositely diagonal girder web plates 71 are rigidly connected at their radially inner edges to juncture of the girder web plates 67 and their extensions 70 with the annular girder boundary web plates series 68. At their radially outer edges the girder plates 71 are joined in convergent relation to the girder boundary member defined by the annular series of vertical girder web plates 69. This defines a continuous annular series of triangular web cells within the second annular girder of the revolving frame 18. About the second revolving frame annular girder is a third annular girder provided by and between the girder boundary member defined by the annular girder plate series 69 and the vertical peripheral wall 50 which defines a girder boundary radially outwardly spaced from the girder boundary defined by the annular vertical web plate series 69. A uniform series of alternately oppositely diagonal vertical web plates 72 arranged in zig zag pattern defines with the girder boundaries of this third girder an annular series of triangular girder cells. At their inner edges the plates 72 are joined convergently to one another and to the girder boundary defined by the annular plate series 69, with certain of the joints thus provided also joining the radially outer edges of the vertical radial plate extensions 70. At their radially outer edges the web plates 72 are convergently rigidly attached to the girder boundary provided by the wall 50. In addition, the revolving frame 18 has at each side adjacent to the boom 22 a mast anchoring projection 73 provided by an array of diagonal cells defined by diagonally extending vertical web plates 74, a radially extending vertical web plate 75 and a vertical wall plate structure 77 to which the outer edge of the radial web plate 75 is secured while the inner edge of such plate is secured to inner convergence of the inner web plates 74.

Between the extension 73 and the platform area 33, the revolving frame 18 is desirably provided with side wing extensions 78 provided with a cellular vertical web plate grid comprising contiguous front triangular cells 79 and 80 and rear triangular cells 81 and 82 with an intervening trapezoidal cell 83. Between the rear cells 81 of the extensions 78, a semicircular girder is defined having a uniform pattern of contiguous web plate triangular cells 84 and 85. While the platform area 33 which extends rearwardly from the semicircular girder, may be provided with a triangular cell grid pattern, since this platform area merely carries a dead counterbalancing load, it may be constructed in any preferred reinforced manner, such as by means of longitudinally extending parallel vertical web plates 87 and any desirable additional cross web plates 88.

By preference, a double web vertical annular rail beam 89 (FIGS. 5, 7 and 8) is provided for supporting the rail 39 of the base frame. The beam 89 is supported on and welded to the base plate 45, and backing bars 90 are provided at the inner sides of the junctures of the spaced vertical webs of the beam 89 and the base plate 45. At their upper edges, the webs of the rail beam 89 support and are welded to an annular horizontal rail pad 91 which is desirably of a thicker plate section than the section of the deck plate 44 into which the pad 91 is welded. Desirably, backing bars 92 are secured to the inner sides of the junctures of the rail beam plates and the pad plate 91. Removable clips 93 secure the rail 39 to the top of the pad 91.

To similar effect, the revolving frame 18 is equipped with an annular vertical dual web rail beam 94 which is welded at its upper side to a stabilizing flange plate 48*a* and at its lower side is welded to an annular rail pad 95 which is welded into the base plate 49. At the inner sides of the welded junctures of the dual webs of the beam 94, backing bars 97 may be provided along the lower edges of the beam webs and backing bars 98 along the upper edges of the beam webs. Removable clips 99 secure the rail 40 to the rail pad 95.

As shown, the rail beam 89 is desirably located concentrically intermediate, and preferably about centrally between, and spaced from the annular girder boundary members of one of the annular girders, herein the girder having the annular boundaries 57 and 59.

In a desirable arrangement, the swing gear 37 is mounted on the deck plate means 44 concentrically over the annular girder which is contiguous at the radially inner side of the annular girder with which the rail beam 89 is associated.

With respect to the revolving frame 18, the rail beam 94 is desirably located substantially midway within the radially outermost annular girder which is bounded by the boundary members 50 and 69.

In the preferred construction, the double web rail beams 89 and 94 serve just their function of transmitting roller loads to the contiguous vertical triangular-cell plates. The overall structural integrity of the respective frames 17 and 18 does not depend on the performance of the rail beams. The beam construction is therefore preferably segmental such that the double rail beam may be replaced or repaired without affecting the structural integrity of the entire frame. Accordingly, as depicted by way of example in FIG. 7, the webs of the double web rail beam 89 are interrupted by the solid intersecting diagonal webs 60 of the associated annular girder in which the beam is located. The several edges of the rail beam segments are secured to the sides of the webs 60 as by means of welding 100. Since the rail pad 91 in a practical sense requires end-to-end splicing of plate segments the splicing is desirably effected as shown at 101 by welding the splices over and in alignment with the top edges of the adjacent underlying webs 60. Vertical reinforcing I-bars 102 are desirably secured as by welding to and between the rail beam web plates.

By preference, the rail beam 94 of the revolving frame 18 is constructed and related to the associated triangular-cell web plates 72 in the same segmental manner as described for the rail beam 89. But if preferred, the plates of the rail beams 89 and 94 may be relatively flat, as compared to the curved formation of the plates of the rail beam 89. Also, the rail pad 95 may be constructed and related to the web plates 72 in segmental, welded arrangement similarly as described for the rail pad 91.

In the embodiment of the present invention as disclosed in FIGS. 9–12, there are some differences in the rail pad structures and in the manner in which the vertical web plates are joined to one another in the frame grid. A typical base frame 103 comprises an annular vertical hub 104 about which there may be five concentric annular girders between a vertically spaced plate deck 105 and base plate 107, a swing gear 108 being mounted on the deck 105. Between the girder boundary defined by the hub 104 and a radially outwardly spaced annular vertically extending girder boundary defined by web structure 109 is attached by welding an annular series of vertical radial girder web plates 110. Extending diagonally between the annular web girder boundary 109 and a radially outwardly spaced concentric annular vertical web girder boundary 111 is an annular zig-zag series of alternately diagonally related vertical girder web plates 112. In the next radially outer annular girder, an annular zig-zag series of uniformly alternately diagonal vertical girder web plates 113 extends between the annular vertical girder web boundary 111 and a radially outwardly spaced annular vertical girder web boundary 114. In the next radially outer girder, an annular uniformly spaced oppositely diagonal zig-zag series of vertical girder web plates 115 is attached to and between the annular web boundary 114 and a radially outwardly spaced vertical annular web boundary 117. In the radially outermost annular girder, defined in a radial space between annular web boundary 117 and an annular base frame enclosure wall and girder boundary 118 is mounted an annular series of oppositely diagonally directed vertical girder web plates 119 having their radially inner and radially outer edges secured fixedly to the girder boundaries 117 and 118. In addition, radial vertical outer girder web plates 120 are desirably connected to and between the annular web boundary 117 and the outer wall girder boundary 118 and midway between adjacent diagonal web plates 119 which diverge from the annular web girder boundary 117. It will thus be apparent that in each of the four outermost annular girders a respective annular series of triangular cells is provided in the web plate grid within the base 103.

Figure 9:
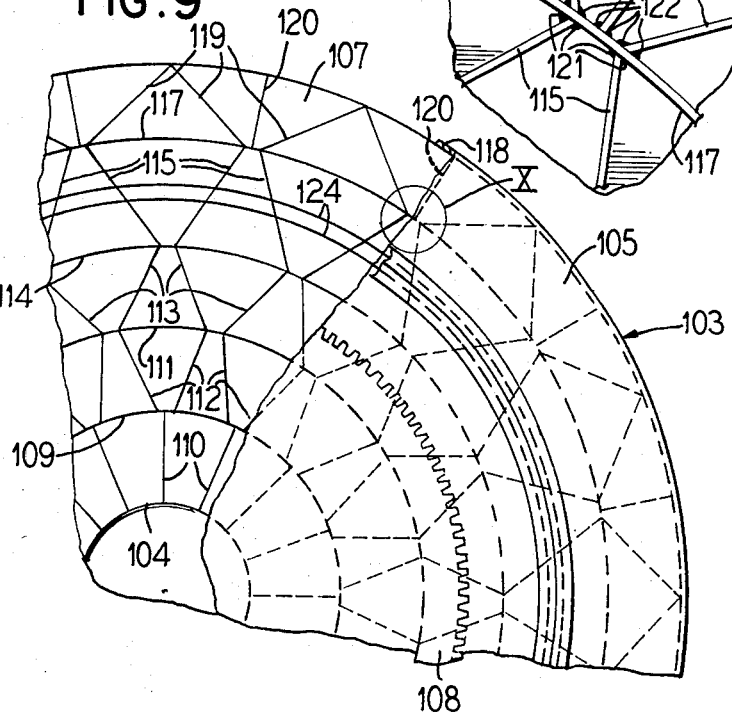
FIG. 9 is a view similar to FIG. 5 but showing a slight modification.
Figure 10:
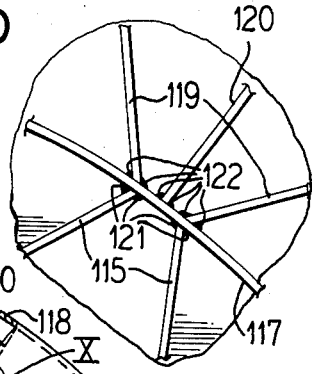
FIG. 10 is an enlarged fragmentary plan detail view taken within the baloon X of FIG. 9.

In a preferred arrangement, the respective diagonal girder web plates in the base 103, similarly as in the frames 17 and 18, are welded at their top edges to the deck plate 105 and at their bottom edges to the base plate 107, and at their respective radially inner and radially outer edges directly to the annular girder web boundaries, as best visualized in FIGS. 9 and 10. Thus, in a typical example as shown in FIG. 10, the diagonal web plates 115 are secured as by means of welding 121 to the annular girder boundary 117. Similarly, the radially inner edges of the web plates 119 and 120 are secured as by means of welding 122 to the annular girder boundary 117. To facilitate welding, and to provide an efficient structural relationship, the welded joints of the vertical plates 115 at the annular girder boundary 117 are circumferentially spaced, and the joints of the diagonal webs 119 are also circumferentially spaced and aligned with the joints of the webs 115. This same general welded attachment of the diagonal web plates and the several annular girder boundaries desirably persists throughout the triangular cell web grid of the base frame 103. It will be noted that the radial web plates 110 are welded to the annular girder boundary 109 in alignment between the welded attachments of the convergently related inner edges of the web plates 112. Although only the base frame 103 has been selected for illustration, it will be understood that an associated revolving frame structure may be similarly constructed with respect to its web grid, if desired, with of course such modifications as may be required for the specific needs of the revolving frame.

For efficiently supporting an annular rail 123 in the frame 103, an annular double web vertical rail beam 124 is mounted on the base plate 107 and carries a rail pad structure 125. In this instance the rail pad 125 is of double tee construction comprising two complementary tee shapes 127 having their horizontal heads secured together by a welded joint 128, and having their vertical legs resting on and welded to the top edges of the webs of the rail beam 124. Desirably, the rail pad 125 is secured by welding into the deck 105 in similar fashion as is the rail pad 91 in the deck 44 in FIG. 8.

Figure 7:
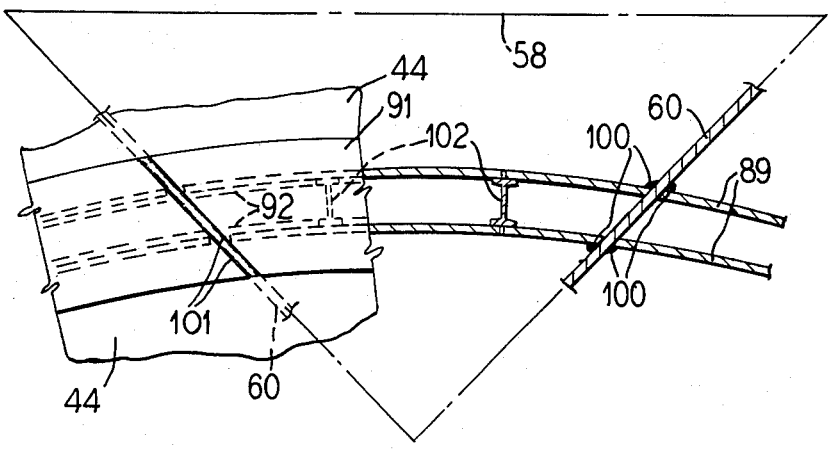
FIG. 7 is a fragmentary sectional plan view, partially schematic, of one of the triangular frame cells and intersecting segments of the associated rail pad and rail beam, relevant to FIGS. 4 and 5.
Figure 11:
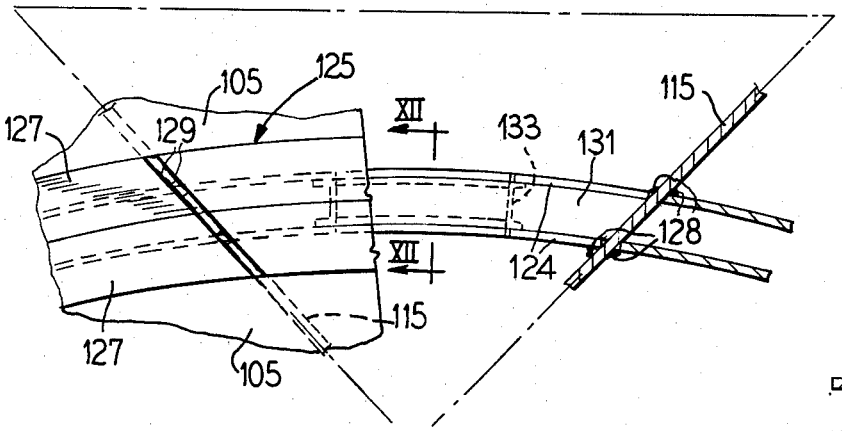
FIG. 11 is a view similar to FIG. 7 but in this instance related to the showing in FIG. 9.
Figure 12:
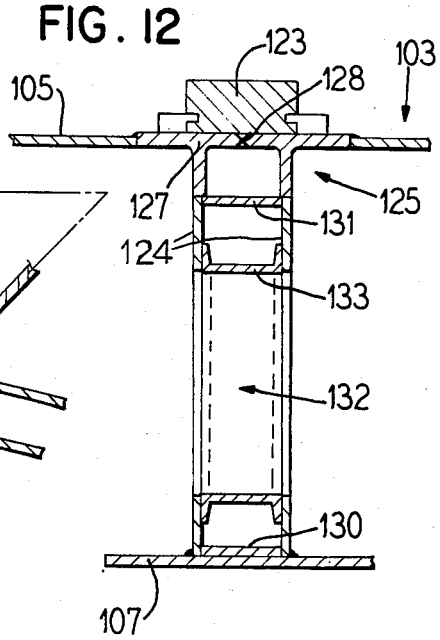
FIG. 12 is a sectional detail view taken substantially along the line XII—XII in FIG. 11.

Similarly as described for the arrangement of FIG. 7, the arrangement of the rail beam and rail pad in FIG. 11 desirably comprises having the rail beam 124 formed in segments welded as at 128*a* (FIG. 11) to and between the diagonal web plates 115. Also, desirably the rail pad 125 is constructed in complementary segments which are joined on welded joints 129 along the tops of the web plates 115. This provides a construction in which the respective segments can be easily and economically replaced if it ever becomes necessary to do so.

Desirably orientation and stabilizer means comprising horizontal spacer bars or plates 130 (FIG. 12) may be secured as by welding between the lower edges of the twin webs of the beam 124. Similarly, spacer plate or bar means 131 may be welded to and between the upper edges of the twin plates of the rail beam 124.

As is customary with frames of the kind with which the present invention is concerned, manholes may be provided at convenient locations for access to the interior of the frame. In addition, one or more manholes 132 may be provided through the rail beam 124 (and also the rail beam 89 of FIG. 8). For reinforcement, the manhole 132 desirably has thereabout a reinforcing ring 133 which preferably comprises a U-shaped transverse cross-section and is welded to the twin plates of the beam 124 about the manhole apertures therein. It will be understood, of course, that suitable manholes may be provided in any of the vertical web plates, as desired.

Figure 4:
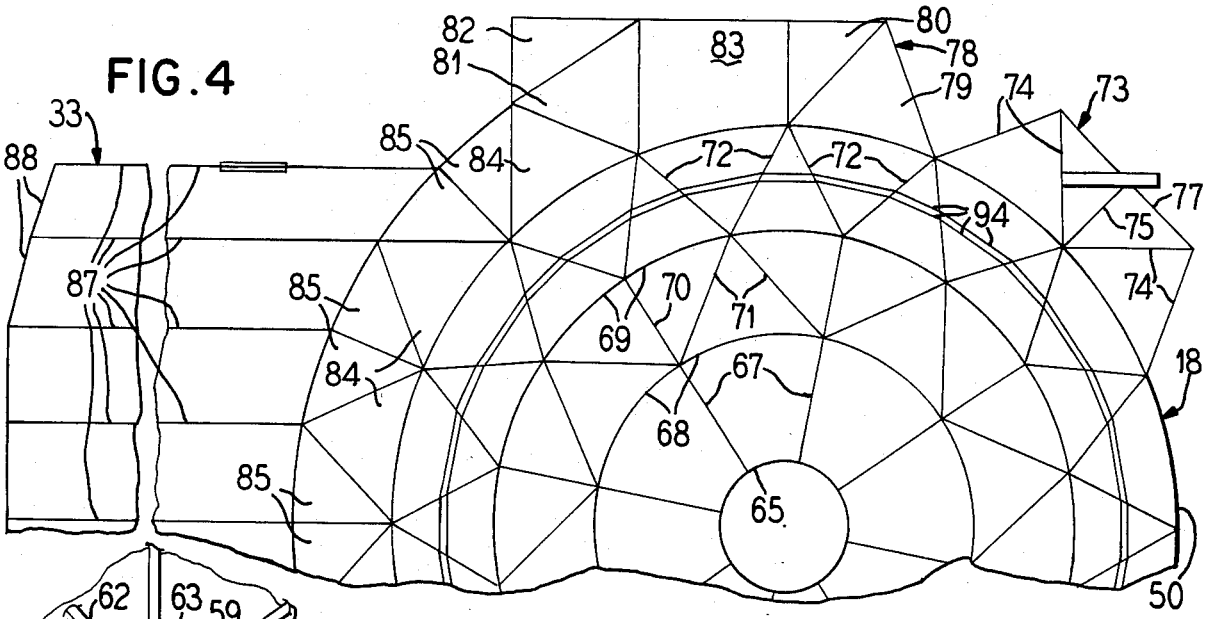
FIG. 4 is an enlarged fragmental schematic sectional plan detail view taken substantially along the line IV—IV of FIG. 3.
Figure 5:
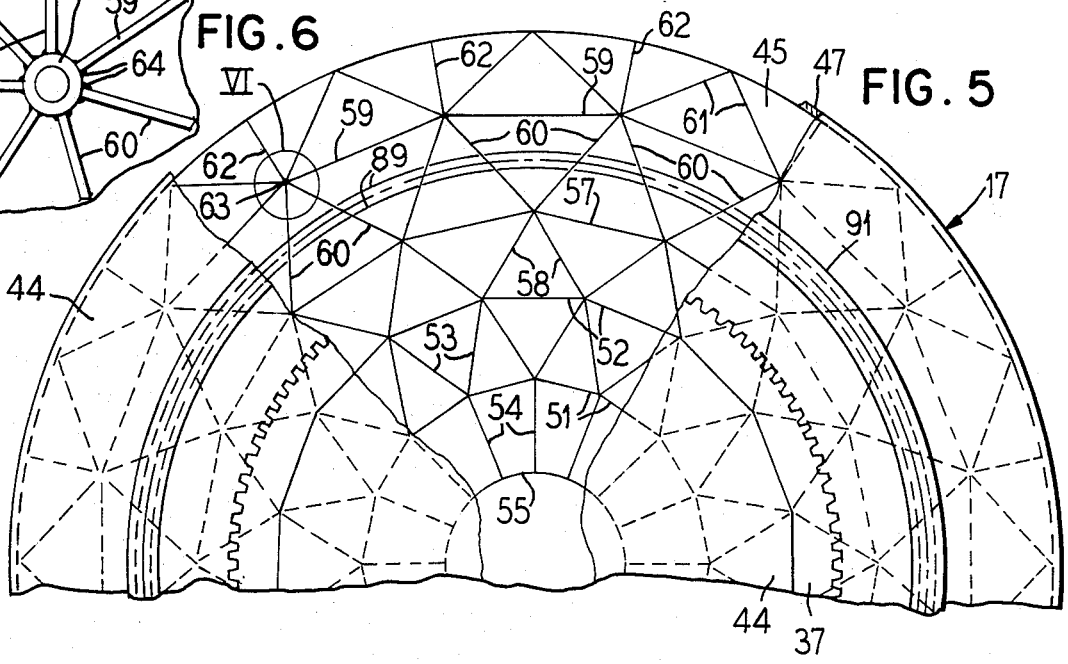
FIG. 5 is a fragmentary, schematic plan view taken substantially along the line V—V of FIG. 3.

By inspection of FIGS. 4, 5 and 9 it will be seen that, the pattern of triangular girder cells in the progressively larger diameter concentric girders define a unique grid system in which the diagonal, triangular cell forming web plates are, in effect, joined in substantially spiral arcs which intersect the annular girder boundaries, there being both right hand and left hand spiral arcs. In addition, it will be observed that the triangular cells of contiguous annular girders define among themselves overlapping polygonal configurations, both quadrangular and hexagonal as well as pentagonal. In any event, by virtue of the triangular cell grid external torsional loads are resisted by bending of the cell plates on their vertical axes rather than twisting or warping as experienced in the conventional arrangements of rectangular or trapezoidal cells. Since the bending strength of cell plates on their vertical axes may be ten to two hundred times as high as their torsional strength, the triangular cell arrangement is adapted to require 25% to 45% less material than prior rectangular or trapezoidal cell arrangements in the frames, or adapted to increase torsional resistance without added material. Further, the triangular cells resist and distribute the external torsional loads by their bending stresses so that there is improved bending and torsional strength resistance of the cells which are not subjected to torsional shear stresses.

The depth of the revolving frame 18 (FIG. 3) is determined by requirements for supporting and distributing maximum concentrated loads at the boom foot and the mast foot. Inside the rail circle of the revolving frame, the required frame depth to support and distribute external loads is about 50% less than the outside depth. Therefore, the central portion of the revolving frame may be of less depth and provide a downwardly opening cavity as shown at 135 inwardly from the annular rail 40 and extending frustoconically upwardly in the base plate means 49 at the bottom of the annular girder defined between the girder boundaries 65 and 68. The radially outer portion of the revolving frame is of greater depth. Thereby, the central portion of the base frame 17, that is the portion lying inwardly from the annular rail 39, may be complementally increased in depth frustoconically, as indicated at 137 and project into the cavity 135. Preferably the frustoconical portion or area 137 of the base frame 17 rises progressively from the boundary member 52 to the axle 35. At the axle 35 the frustoconical area 137 may be about twice the thickness of the base frame 17 radially outwardly from the boundary member 52.

By virtue of this complementary differential height or depth ratio of the frames, the relative stiffness ratio of the base frame and the revolving frame may be designed to approach a ratio of 1:1, without increasing the combined depth of the base frame and the revolving frame. This desirable increased, improved stiffness ratio better utilizes all structural elements in both frames. Nevertheless, the triangular cell web grid may be used for replacements of existing uniform height base frames.

It will be understood that variations and modifications may be effected without departing from the spirit and scope of the novel concepts of this invention.

I claim as my invention:

1. In a walking dragline excavator including a circular base frame adapted to lie directly in self-supporting relation on a ground level area and supporting a revolving frame connected to the base frame for rotation about an axis concentric with the base frame and wherein each of said frames comprises a massive hollow internally reinforced substantially planar horizontal load sharing frame structure:

each of said frame structures comprising a horizontal upper deck plate substantially vertically spaced above a lower horizontal base plate;

each of said frame structures having internal reinforcement comprising a plurality of concentric annular vertical girders supporting said deck plate on and in vertically spaced relation above said base plate;

each of said annular girders in each of said frame structures comprising concentric radially spaced vertical annular girder boundary webs fixedly connected by a respective zig-zag array of vertical alternately oppositely diagonally extending web plates forming with said annular girder boundary webs a symmetrical annular series of generally triangular cells in each of said girders;

all contiguous annular girders in each of said frame structures having one of said annular boundary webs forming a common boundary between the annular girders;

all of said boundary webs and all of said web plates being welded at their upper edges to the deck plate in the frame structure with which associated and all of the boundary webs and all of said web plates being welded at their lower edges to the base plate of the associated frame structure;

so that the boundary webs and the web plates in the triangular cell arrangement together with the deck and base plates in each frame structure function cooperatively to resist torsional stresses and to assume working loads by bending resiliently vertically under vertically imposed loads in the operation of the dragline excavator.

2. A walking dragline excavator according to claim 1, wherein:

each of said frame structures having a respective vertical annular double web rail beam mounted between the deck plate means and the base plate means of the structure and located concentrically intermediate and spaced from the annular girder boundary members of one of said annular girders in each of the frame structures and rigidly connected to the diagonally extending vertical web plates of said one girder of the frame structure in each instance without interfering with the integrity and function of the web vertical plates;

said rail beams in said revolving frame structure and said base frame structure being in axial, load sharing alignment;

said rail beam of said base frame structure having an edge adjacent to the deck plate means of the base frame structure;

said rail beam of said revolving frame structure having an edge adjacent to the base plate means of said revolving frame structure;

annular rail pad means rigidly connected to said edge of said base frame rail beam and to said base frame deck plate means;

annular rail pad means rigidly connected to said edge of said revolving frame rail beam and to said revolving frame base plate means;

respective rail means carried by said rail pad means of each of said frame structures;

and rotary load transmitting rollers engaged by and between said rail means of said frames.

3. A walking dragline excavator according to claim 1, wherein said revolving frame structure has in its base plate a central generally frustoconical downwardly opening cavity concentric with said axis, said base frame structure having a central area including its deck plate providing an upward generally frustoconical projection concentric with said axis and complementary to and received in said cavity of the revolving frame structure, and at least one annular girder of said base frame structure in said projection.

4. A walking dragline excavator according to claim 1, wherein the relative stiffness ratio of said revolving frame structure and said base frame structure approaches 1:1.

5. A walking dragline excavator according to claim 4, wherein said revolving frame structure has a cavity in its base plate for progressively diminishing the thickness of a central area of the revolving frame structure, and the central portion of the base frame structure is complementally increased in depth and projects into said cavity whereby to implement said 1:1 stiffness ratio.

6. A massive hollow internally reinforced substantially planar horizontal load sharing frame structure for a walking dragline excavator of the kind having a base frame and a supported revolving frame, and comprising:

a horizontal upper deck plate substantially vertically spaced above a lower horizontal base plate;

a plurality of concentric annular girders supporting said deck plate in said vertically spaced relation to said base plate;

each of said annular girders comprising concentric radially spaced vertical annular girder boundary webs fixedly connected by a respective zig-zag array of vertical alternately oppositely diagonally extending web plates forming with said annular girder boundary webs a symmetrical annular series of generally triangular cells in each of said girders;

said annular girders having one of said annular girder boundary members forming a common boundary between the contiguous girders;

all of said boundary webs and all of said web plates being welded at their upper edges to the deck plate and all of the boundary webs and all of said web plates being welded at their lower edges to the base plate;

so that the boundary webs and the web plates in the triangular cell arrangement together with the deck and base plates function cooperatively to resist torsional stresses and to assume working loads by bending resiliently vertically under vertically imposed loads in the operation of the dragline excavator.

7. A frame structure according to claim 6, wherein said vertical web plates and said girder boundary webs define a grid of overlapping polygonal configurations when viewed in plan and including hexagonal formations each of which has therein a plurality of said triangular cells.

8. A frame structure according to claim 6, wherein said annular girder boundary webs comprise vertical plates joined in end-to-end relation and welded at their vertical edges to vertical joint posts to which respective edges of said web plates are also welded.

9. A frame structure according to claim 6, wherein said frame structure includes an annular girder on the outer perimeter of the frame structure and such outer perimeter girder has an outer annular vertical perimeter boundary wall providing a perimeter for the frame structure, said outer perimeter girder having radially extending vertical web plates located at circumferentially uniform intervals between oppositely diagonally extending vertical web plates, and all of said web plates of said outer perimeter girder having radially outer edges fixed to said outer perimeter wall and radially inner edges fixed to a radially inner vertical boundary web of said outer perimeter girder.

10. A frame structure according to claim 6, comprising a walking dragline base frame having a central frustoconical portion of substantial area and of greater depth than the area of the base frame radially outwardly therefrom and projecting upperwardly and adapted to be received in a complementary cavity area of a revolving frame.

11. A frame structure according to claim 6, wherein said one girder has another similar girder in concentric surrounding relation thereto and has a common girder boundary member with said one girder, said another girder having thereabout a radially outer vertical annular boundary providing an outer wall defining the perimeter of the frame structure, and a uniform array of circumferentially spaced radially extending vertical web plates and intervening convergently related diagonal vertical web plates connected fixedly to said outer perimeter wall and the common girder boundary member and defining a continuous annular series of triangular cells in said another girder.

12. A frame structure according to claim 6, wherein an annular girder radially inwardly from said one girder carries a concentric swing gear.

13. A frame structure according to claim 6, which serves as a revolving frame and which has fixedly connected to and about said one girder thereof a radially outwardly extending counterweight platform area, as well as radially outwardly extending side wing extensions and also radially outwardly extending mast anchoring projections.

14. A frame structure according to claim 13, wherein each of said platform area and side wing extensions and mast anchoring projections has an internal reinforcement construction comprising at least in part relatively diagonally extending and radially extending vertical web plates having radially inner ends fixedly connected to the radially outer annular girder boundary member of said one annular girder.

15. A frame structure according to claim 6, wherein:

a vertical annular rail beam is mounted between and rigidly secured concentrically intermediate and spaced from the annular girder boundary webs of one of said annular girders and rigidly connected to the diagonally extending vertical web plates of said one girder without interfering with the integrity and functioning of the web plates;

and annular rail pad means rigidly connected to an edge of said rail beam and to one of said base and deck plates and being supportive of rail means for engagement by rotary load carrying rollers in a walking dragline excavator.

16. A frame structure according to claim 15, wherein said annular rail pad means is of double-T construction with a pair of annular spaced parallel vertical legs of the pad attached to the rail beam.

17. A frame structure according to claim 18, wherein said annular rail pad means comprises an annular series of complementary segments welded together at and onto said web plates of said one girder.

18. A frame structure according to claim 15, wherein said annular rail beam comprises a connected series of segments welded to the sides of said web plates of said one girder.

19. A frame structure according to claim 15, wherein said rail beam comprises concentric annular radially spaced vertical twin plates having aligned manhole apertures therethrough, and a U-shaped transverse cross section reinforcing ring welded to the twin plates about the manhole apertures.

20. In a walking dragline excavator including a circular base frame adapted to lie directly in self-supporting relation on a ground level area and supporting a revolving frame connected to the base frame for rotation about an axis concentric with the base frame and wherein each of said frames comprises a massive hollow internally reinforced substantially planar horizontal load sharing frame structure:

each of said frame structures comprising substantially vertically spaced apart horizontal upper deck plate and lower horizontal base plate;

each of said frame structures having an arrangement of vertical web plates secured in a reinforcing grid to and between said deck and base plates;

each of said frame structures having a respective vertical annular rail beam mounted between the deck plate and the base plate of the structure and located concentrically intermediate the outer perimeter of the respective frame structure and a central area of the frame structure;

said rail beams in said revolving frame structure and said base frame structure being in axial, load sharing alignment;

said rail beam of said base frame structure having an edge adjacent to the deck plate of the base frame structure;

said rail beam of said revolving frame structure having an edge adjacent to the base plate of said revolving frame structure;

annular rail pad means rigidly connected at said edge of said base frame rail beam and to said base frame deck plate means;

annular rail pad means rigidly connected at said edge of said revolving frame rail beam and to said revolving frame base plate means;

respective rail means carried by said rail pad means of each of said frame structures;

rotary load transmitting rollers engaged by and between said rail means of said frame structures;

said revolving frame structure having in its base plate means a central generally frustoconical downwardly opening cavity of substantial diameter concentric with said axis;

said base frame structure having a central area including its deck plate means providing an upward generally frustoconical projection concentric with said axis and complementary to and received in said cavity of the revolving frame structure.

21. A walking dragline excavator according to claim 20, wherein said frame structures have concentric annular girders therein, at least one of the annular girders of said revolving frame structure being concentrically within the area of said downwardly opening frustoconical cavity, and a plurality of the annular girders within said base frame structure lying within said generally frustoconical upward projection of said base frame

22. A walking dragline excavator according to claim 20, wherein said base frame structure has an annular swing gear mounted on said deck plate of said base frame structure adjacent to the radially outer edge of said generally frustoconical upward projection.

* * * * *